United States Patent [19]

Saurwein

[11] Patent Number: 4,526,000

[45] Date of Patent: Jul. 2, 1985

[54] PRESSURE INTENSIFIER

[75] Inventor: Albert C. Saurwein, Auburn, Wash.

[73] Assignee: McCartney Manufacturing Co., Inc., Baxter Springs, Kans.

[21] Appl. No.: 541,827

[22] Filed: Oct. 18, 1983

[51] Int. Cl.[3] ..... F04B 35/00; F01L 25/04

[52] U.S. Cl. ..... 60/540; 60/593; 91/239; 91/450

[58] Field of Search ..... 60/537, 540, 593; 91/275, 239, 449, 450; 417/397; 137/625.3, 625.69

[56] References Cited

U.S. PATENT DOCUMENTS

| | | | |
|---|---|---|---|
| 3,811,795 | 5/1974 | Olsen | 417/397 |
| 3,905,608 | 9/1975 | Olsen et al. | 277/188 |
| 3,976,401 | 8/1976 | Mountain | 91/275 |
| 4,026,322 | 5/1977 | Thomas | 137/512 |
| 4,029,440 | 3/1976 | Olsen | 91/305 |
| 4,155,535 | 5/1979 | Seamone | 137/625.69 |
| 4,245,816 | 1/1981 | Johnson | 137/625.3 |

OTHER PUBLICATIONS

*Hydraulic and Pnematic Power for Production,* Harry L. Stewart, pp. 6-9, 6-10, Nov. 23, 1970.

*Primary Examiner*—Robert E. Garrett
*Attorney, Agent, or Firm*—B. J. Murphy

[57] ABSTRACT

A first pressure-intensifying apparatus includes a working cylinder having a working piston mounted within it and reciprocally movable by the application of working fluid alternately to opposite sides of the working piston. The working piston in turn drives a high-pressure piston movably mounted within a high-pressure cylinder. The flow of pressurized working fluid to the working cylinder is controlled by a control valve. The control valve receives pressurized fluid from a source of working fluid and directs the fluid to the working cylinder and then back to a working fluid reservoir or tank. The control valve includes a valve body and has a spool movably mounted therein that is movable between a first position in which fluid is directed to one side of the working piston and a second position in which fluid is directed to the other side of the working piston. The spool is designed to maintain a constant volumetric flow of fluid from the source to the tank at the first and second positions and all positions in between. In order to accomplish this, a series of slots are formed in the surface of the spool to divide the flow of fluid between the source and the working cylinder and the source and the tank at the intermediate positions of the spool in a predetermined fashion. Also, preferably, the construction of the working piston and the high-pressure piston permits for limited radial movement between the working piston and the high-pressure piston to compensate for misalignments between the working cylinder and the high-pressure cylinder.

7 Claims, 5 Drawing Figures

PRESSURE INTENSIFIER

BACKGROUND OF THE INVENTION

This invention relates to fluid pressure-intensifying devices and more particularly, relates to a fluid intensifier having a double-acting piston that operates with minimal shock at the point of transition in direction of motion of the double-acting piston.

In systems requiring high-pressure fluids, for example, water jet cutting or drilling, it is common to use an intensifier that receives fluid, e.g., water, from a low-pressure source and increases the pressure of the fluid to the desired pressure. A typical intensifier will include a low-pressure or working cylinder with a double-acting piston therein, the low-pressure cylinder having opposing high-pressure barrels affixed to it. A high-pressure piston is slidably mounted within each of the high-pressure barrels and the high-pressure pistons are attached to the low-pressure piston such that the high-pressure pistons reciprocate in unison with the reciprocation of the low-pressure piston. A working fluid, such as oil, is alternately pumped into opposite chambers of the low-pressure cylinder to provide a reciprocal motion of the low-pressure piston and low-pressure water is alternately fed into the opposing high-pressure barrels to be compressed and forced from the cylinder by the high-pressure piston acting in conjunction with the low-pressure piston. Typically, the high-pressure piston has a cross-sectional area much smaller than that of the low-pressure piston. It is therefore possible to obtain an increase in the pressure of the water within the high-pressure cylinder while using a lower pressure hydraulic system to move the working piston.

In a reciprocating pressure intensifier there is a tendency for shock at the end of the high-pressure piston at the moment of reversal of direction of the high-pressure piston motion. It is desirable to provide a system of controlled reversal of the direction of motion of the high-pressure piston that minimizes this shock. One such system is shown in the U.S. Pat. No. 4,029,440 issued to Olson, June 14, 1977. The Olson system utilizes a method of controlling the pressure on either side of the low-pressure piston to provide a smooth transition in direction of the low-pressure piston. The pressure control is accomplished by controlling the area of the valve surfaces of a control valve, which controls the flow of fluid into the low-pressure cylinder, in accordance with a prescribed formula set forth in the Olson patent. While the Olson system works in theory, it is believed more practical to control the reversal to eliminate shock through control of the flow rate of working fluid instead of the pressure.

It is therefore an object of the present invention to provide a fluid intensifier including a double-acting piston assembly, which minimizes the shock experienced by the high-pressure piston assembly at the time of reversal of direction of motion of the piston assembly.

It is a further object of the invention to provide a fluid intensifier in which the flow rate of working fluid in the low-pressure cylinder is controlled to accomplish the smooth transition of direction of motion of the working piston.

SUMMARY OF THE INVENTION

In accordance with the above-stated objects, a fluid pressure-intensifying apparatus designed to accept an infusion of a fluid at low pressure, such as water, and output that fluid at a high-pressure stream includes a working piston mounted for reciprocal movement within a working cylinder. The working piston divides the working cylinder into first and second chamber. A high-pressure cylinder is coaxially mounted on a first end of the working cylinder. The high-pressure piston is mounted within the high-pressure cylinder and is operably connected to the working piston to be reciprocally driven by the working piston. A control valve assembly is operatively associated with the working cylinder to direct fluid from a source of pressurized working fluid, alternately, to the first and second chambers of the working cylinder and back to a reservoir of working fluid to cause the reciprocal motion of the working piston. The control valve includes a valve body that has a pressure port connected to the source of pressurized working fluid, two working ports connected respectively to the first and second chambers of the working cylinder and at least one tank port connected to the reservoir of working fluid. A control valve spool is mounted within the valve body and moves between a first position in which it directs working fluid to the first chamber and a second position in which it directs working fluid to the second chamber. The spool is designed to maintain a constant volumetric flow of working fluid from the source to the reservoir at both the first and second positions of the spool and also during the transition of the spool from the first position to the second position and back.

In the preferred embodiment, the flow of working fluid from the source to the tank is channeled through slots milled into the surface of the spool. The slots are operable when the valve spool is intermediate the first and second positions to bypass a predetermined amount of the working fluid from the source directly to the reservoir without flowing into the working cylinder. At the center position of the spool there is no flow into or out of the working cylinder and all flow is maintained through the slots from source to reservoir.

Preferably, the high-pressure cylinder is coaxially aligned with the working cylinder and the high-pressure piston is coaxially aligned with the working piston. The working piston includes an annular piston portion and a circular insert portion that is mounted within the center opening of the annular portion. The high-pressure piston is press fit into a bore in the circular insert. The diameter of the circular insert is slightly smaller than the diameter of the central opening of the annular portion to permit a limited degree of radial movement of the insert with respect to the annular portion to compensate for misalignments between the high-pressure cylinder and the working cylinder or between the working piston and the high-pressure piston.

BRIEF DESCRIPTION OF THE DRAWINGS

The objects and advantages of the present invention will be better understood by those of ordinary skill in the art and others upon reading the ensuing specification when taken in conjunction with the appended drawings wherein.

DETAILED DESCRIPTION OF THE PREFERRED EMBODIMENT

Figure 1:
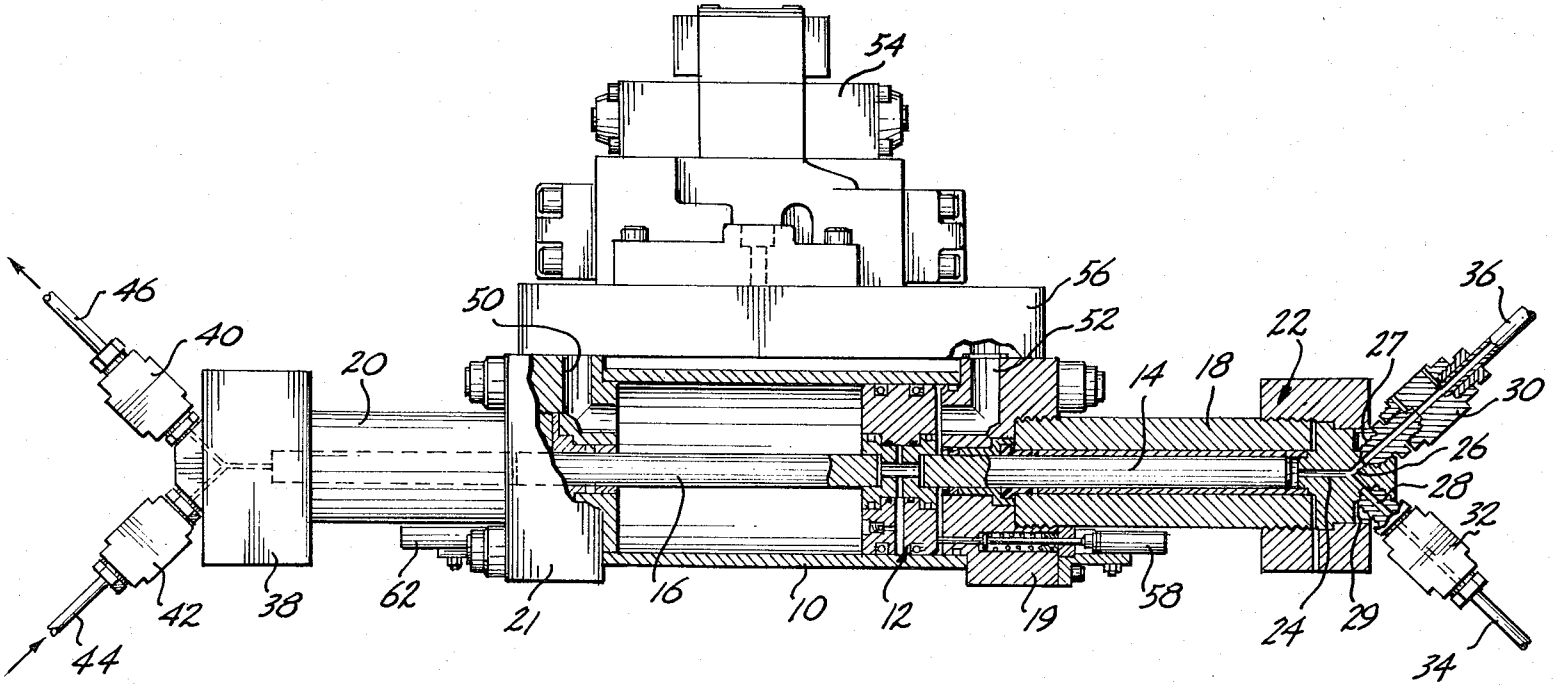
FIG. 1 is a side elevational view in partial section of one embodiment of a fluid pressure intensifier made in accordance with the principles of the present invention.

FIG. 1 shows in partial cross section one embodiment of a pressure intensifier made in accordance with the principles of the present invention. The basic elements of the intensifier include a low-pressure cylinder 10 and a low-pressure piston assembly 12 reciprocally movable in the cylinder. In the view of FIG. 1, the low-pressure piston is shown at its extreme right-hand position within the cylinder 10. A first high-pressure piston 14 is affixed to a first side of the low-pressure piston assembly 12 and a second high-pressure piston 16, identical to the first high-pressure piston, is attached to the opposing side of the low-pressure piston assembly 12. The high-pressure piston 14 is reciprocally movable in a first high-pressure barrel 18 that threadably engages a first end-block 19 that is in turn affixed to a first end of the low-pressure cylinder 10. A second high-pressure barrel 20 threadably engages a second end-block 21 that in turn is affixed to a second end of the low-pressure cylinder 10. The second high-pressure piston 16 is reciprocably movable within the second high-pressure barrel 20. A first transition block 22 threadably engages a first end of the first high-pressure barrel 18 and has a passageway 24 formed therethrough in communication with the interior space of the first high-pressure barrel 18. The passageway 24 branches into a high-pressure passage 26 and a low-pressure passage 28 that extend from the passageway 24 and form substantially a right angle with respect to one another. The passageways lead respectively to high-pressure port 27 and low-pressure port 29, which in turn have check valves 30 and 32, respectively, mounted therein. The check valve 32 is in line with a low-pressure water line 34 that leads to a source of low-pressure water, not shown. The check valve 30 is in line with a high-pressure water line 36, which leads to a device utilizing the high-pressure water such as water jet cutting nozzle. The check valves 30 and 32 are identical, except for the direction of flow permitted by the check valve. The check valve 32 permits low-pressure fluid from the low-pressure fluid source to enter passageways 28 and 24, and hence, enter the interior of the first high-pressure barrel 18, but blocks the exit of fluid from the first high-pressure barrel. Conversely, the check valve 30 permits a flow of fluid from the interior of the first high-pressure barrel 18 through the passageways 24 and 26 out to the high-pressure line 36 but blocks the flow of fluid from the high-pressure line back into the first high-pressure barrel.

The configuration of the left side, as viewed in FIG. 1, of the pressure intensifier is identical to that described above. A second transition-block 38 is threadedly engaged with a first end of the second high-pressure barrel 20 and has internal fluid passageways identical to those formed in the first transition-block 22. The passageways in the second transition block 38 lead to ports in which are mounted check valves 40 and 42, the check valve 42 being connected to a low-pressure line 44 leading to the same source of low-pressure water as low-pressure line 34. Check valve 40 is connected in a high-pressure line 46 connected to the same water jet cutting nozzle or other device that is connected to high-pressure line 36. Check valves 40 and 42 are identical with each other and with check valves 30 and 31, except that they are installed to prevent flow in different directions. Check valve 42 allows flow from the low-pressure water source through line 44 into the second high-pressure barrel 20 but prevents flow from the second high-pressure barrel back out to the low-pressure water source. Check valve 40 is installed so that it permits a flow of high-pressure fluid from within the second high-pressure barrel 20 to the high-pressure line 46 but prevents a reverse flow from the high-pressure line 46 back into the second high-pressure barrel 20.

As in a typical double-acting hydraulic cylinder, a working fluid, e.g., oil, enters the left portion of the low-pressure cylinder 10 through a port 50 to force the piston assembly 12 to the right. Oil exits the right portion of the cylinder 10 through a port 52. A control valve assembly 54 is mounted on the cylinder in association with a manifold assembly 56. The manifold assembly 56 has ports formed therein that channel the flow of oil in and out of the low-pressure cylinder 10 through the control valve to a tank supply of oil. A conventional pump (not shown) feeds the oil from the tank supply through the control valve to the low-pressure cylinder 10 at a predetermined working pressure, in the preferred embodiment, 2700 psi. The manifold 56 and the valve body of the valve assembly 54 are conventional items and will not be described in further detail. The spool associated with the control valve assembly 54 is a part of this invention and will be described in greater detail below.

When the working piston 12 reaches the full length of its right-hand travel, the control valve 54 acts to reverse the flow of oil into the cylinder 10 so that the oil enters the cylinder 10 at port 52 and exits at port 50, thereby causing the piston assembly 12 to move to the left. As the working piston assembly 12 moves right and left in the low-pressure cylinder 10, it carries with it the high-pressure pistons 14 and 16 that correspondingly compress and pressurize the water in the high-pressure barrels 18 and 20, depending on the direction of motion of the piston assembly. Since the cross-sectional area of the high-pressure piston is much less than the cross-sectional area of the low-pressure piston assembly, the pressure produced by the high-pressure piston is much greater than the working fluid pressure in the low-pressure cylinder. The high-pressure fluid can be on the order of 40,000 to 60,000 psi, depending on the environment in which the high-pressure water is to be used.

While several different types of control valves can be used, the preferred embodiment of the invention utilizes a solenoid-actuated control valve. A limit switch 58 is mounted on the end-block 19. A spring-loaded shaft 60 from the limit switch 58 extends a predetermined distance into the interior chamber of the low-pressure cylinder 10. As the low-pressure piston assembly 12 approaches its extreme right-hand position, the shaft 60 is moved to the right, thereby activating the limit switch 58, signaling the solenoid valve 54 to shift the direction of flow of fluid into the low-pressure cylinder so as to reverse direction of the low-pressure piston 12. An identical limit switch 62 is mounted on the opposite side of the intensifier in association with end-block 21 and operates to signal the solenoid valve 54 when the low-pressure piston assembly 12 approaches its maximum left-hand displacement. The valve 54 then reverses the flow of oil to the cylinder 10 to reverse the direction of the piston assembly 12. In this manner, therefore, the intensifier accepts low-pressure water and increases the pressure of the water to provide it to the high-pressure water line.

Figure 2:
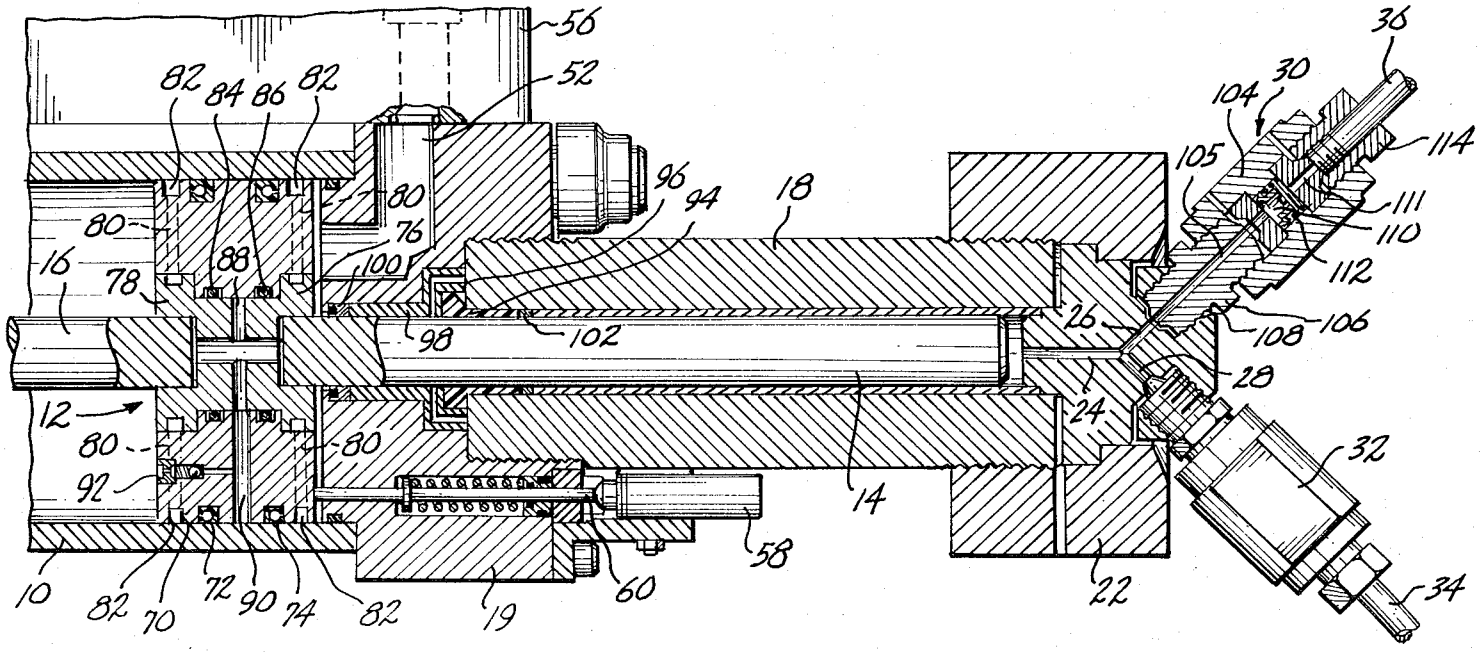
FIG. 2 is a side elevational view in cross section of a portion of the fluid intensifier shown in FIG. 1 in expanded scale.

Some of the details of construction of the intensifier are more clearly illustrated in FIG. 2. The piston assembly 12 includes a low-pressure piston portion 70 of substantially annular configuration, first and second sealing members, 72 and 74, respectively, lie within grooves circumferentially formed in the exterior surface of the low-pressure piston portion 70 to provide a seal against flow of working fluid around the exterior of the piston as it moves within the low-pressure cylinder 10. The high-pressure piston 14 is press fit into a bore axially formed in a circular piston insert 76, which, in turn, fits into the interior opening of the annular low-pressure piston. A shoulder formed on the insert 76 cooperably engages a ledge formed in the interior opening of the low-pressure piston 70 to seat the insert. The high-pressure piston 16 is similarly press fit into a second circular piston insert 78, which, in turn, is mounted within the low-pressure piston portion 70. The piston inserts 76 and 78 are held in place within the low-pressure piston portion by keys 80 inserted through slots axially formed in the low-pressure piston portion. The keys 80 engage cooperative slots formed in the piston inserts 76 and 78. The keys 80 therefore maintain the piston insert in position within the low-pressure piston portion 70. The keys 80 are driven into the low-pressure piston a distance such that they are spaced from the outer circumferential surface of the piston portion 70 and a nylon retainer 82 is inserted into each of the open slots to retain the keys in their respective slots and also to prevent scoring of the interior walls of the low-pressure cylinder. O-rings 84 and 86 are in sealing relationship within grooves formed in the low-pressure piston portion to prevent any leakage of oil between piston portion 70 and piston inserts 76 and 78. Passageway 88 is formed between the inserts 76 and 78 and communicates with a passageway 90 formed in the low-pressure piston portion 70 to bleed any oil that does leak behind the inserts back out to the interior chamber of the low-pressure cylinder through a check valve assembly 92, which prevents the flow of oil from the chamber into the passageway 90, but permits the flow of oil out from the passageway 90 to the interior of the low-pressure cylinder.

One problem in constructing a piston assembly for use in an intensifier is in maintaining the low-pressure pistons concentric with one another and the high-pressure and low-pressure cylinders concentric with one another so that there is no binding of the pistons against the cylinder walls during reciprocal movement of either the low-pressure or high-pressure pistons. Since this concentric configuration is difficult to maintain, the piston assembly shown and described herein is preferably constructed by first grinding and lapping the high-pressure pistons, which are preferably of tungsten carbide or some other hard material, and press fitting them into the inserts, which at the time are rough machined. The inserts are not finish machined until after the high-pressure piston has been inserted into them, so that each insert can be machined to be very closely coaxial with its associated piston. The assembled insert and piston are then placed into the low-pressure piston and the keys driven through the low-pressure piston into the slots formed in the inserts and the nylon retainers inserted in the grooves adjacent the outer periphery of the low-pressure piston. The diameter of the inner bore of the low-pressure piston portion is made to be larger than the diameter of the insert by a distance of approximately 0.002 to 0.003 inches to permit limited radial displacement of the inserts within the low-pressure piston portion to accommodate for any radial displacement of the high-pressure pistons relative to the axis of the high- and low-pressure cylinders and to accommodate eccentricities of the bushings. It has been found that a clearance of the order mentioned above is sufficient to accommodate any such eccentricity.

Another problem presented by high-pressure fluid intensifiers of the type described herein is in the area of attachment of the high-pressure barrels, 18 and 20, to their respective end-blocks, 19 and 21. Due to the high forces produced during the pumping stroke, and subsequent relaxation on the return stroke, there is a cyclic stretch and shrink at the surfaces of the machined elements at the interface between the first end-block 19 and the second end of the first high-pressure barrel 18, and similarly, between the second high-pressure barrel 20 and the second end-block 21. It should be remembered that the pressure intensifier is symmetric about its centerline and that any description of structure with regard to the right-hand portion of the intensifier applies equally to the left-hand portion. A sealing element 94 is inserted at the juncture of the first high-pressure barrel 18 to first end-block 19. The cyclic stretch and shrink action described above creates varying clearances between the interface between the high-pressure barrel and the end-block, which over a period of time initiates extrusion of the sealing member 94 into these spaces. In the past, extrusion of high-pressure seals has been dealt with by attempting to preload members such that the preload strains were slightly greater than those during loading, thus permitting no clearances to develop. While this is a sound approach, the production of the required preloads manually, by mechanical means such as a wrench or other hand tool, is very difficult. The invention, therefore, permits the normal hydrostatic compression in the seal medium itself to load a hydrostatic ring 96 in such a way that the axial component of force around the ring forces the ring to follow the cyclically moving surface during the pumping stroke, and then return, by the force of the surface, as the previously stressed elements relax. The seal member 94 has a first annular portion that surrounds the high-pressure piston 14 and a second annular portion that extends axially from the first portion. The inner diameters of the two portions are equal but the outer diameter of the second portion is greater. The first portion is interposed between the high-pressure barrel 18 and the high-pressure cylinder 14. The second portion of the seal member 94 is not within the barrel 18 and is of substantially rectangular cross section, except that the corner of the seal immediately adjacent the barrel 18 is chamfered. A hydrostatic ring 96 of substantially triangular cross section is inserted between the chamfered corner of the seal in insert 94 and the end of the barrel 18 and is of a dimension to complete the rectangular cross-sectional profile of the insert portion. An insert body 98 is interposed between the seal element 94 and the first end-block body 19 and has a tail portion that extends toward the low-pressure cylinder. A low-pressure seal 100 is inserted surrounding the high-pressure piston 14 to seal against the passage of oil from the low-pressure cylinder chamber to the first high-pressure barrel 18. The low-pressure seal 100 can be any suitable conventional seal such as a polypack and O-ring seal. Another O-ring 102 is placed into the low-pressure barrel ahead of the seal element 94 to assist in sealing against high-pressure water leaking past the seal. During the pressure stroke, the first high-pressure barrel 18 is forced away from the first end-block 19, which tends to open the interface between the end-block and the high-pressure barrel. This is where extrusion of the pressurized seal element 94 can occur. However, during the pressure stroke the hydrostatic ring 96 is forced to follow the surface of the first high-pressure barrel as the seal 94 swells under pressure, forcing the hydrostatic ring axially. Upon relaxation of the pressure upon the return stroke of the first high-pressure piston, the ring 96 returns to the configuration pictured in FIG. 2. The hydrostatic ring thus blocks extrusion of the seal element 94 into the space created by the movement of the first high-pressure barrel 18 with relation to the first end-block 19.

It is once again to be noted that the check valves 30, 32, 40, and 42 are of identical structure and are simply arranged to provide flow in the desired direction for the particular line to which they are connected. The check valve 30 includes a valve body 104 having a valve bore formed therein. The valve body 104 is threadably connected to a coupling 106, which in turn threadably engages the fluid exit opening 108 in the transition block 22. A passageway 105 through the coupling 106, in fluid communication with the passage 26, directs high-pressure fluid from the interior of the high-pressure barrel 18 to a poppet 110 that is spring-loaded by a spring 112 against the first end of the passageway through the coupling 106. The poppet 110 prevents the passage of fluid of a pressure less than the bias pressure of the spring 112. When the pressure of the spring 112 is overcome, which it is by the high-pressure fluid exiting the intensifier, the poppet is forced away from the opening of the passageway 105 and fluid flows around the fluted edges of the poppet 110 to a passageway 111, which exits the valve body 104. The passage 111 is in fluid communication with the high-pressure line 36, which is connected to the valve by means of a threaded coupling 114. Fluid attempting to flow back from the line 36 through the check valve 30 forces the poppet 110 in the direction of the bias force of spring 112 positioning the poppet in blocking relationship to the passage 105, thereby preventing the passage of fluid from the high-pressure line 36 back into the high-pressure barrel 18. The above description applies to all of the check valves utilized in this intensifier, the valves simply being turned around to achieve the desired flow direction.

Figure 4:
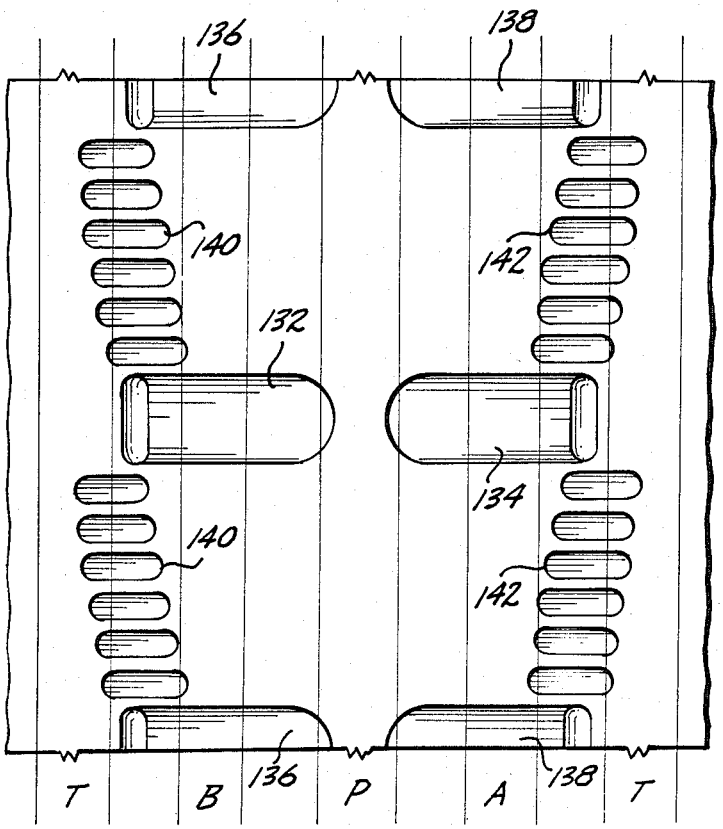
FIG. 4 is the projection onto a plane of the unrolled surface of the valve spool of FIG. 3.
Figure 3:
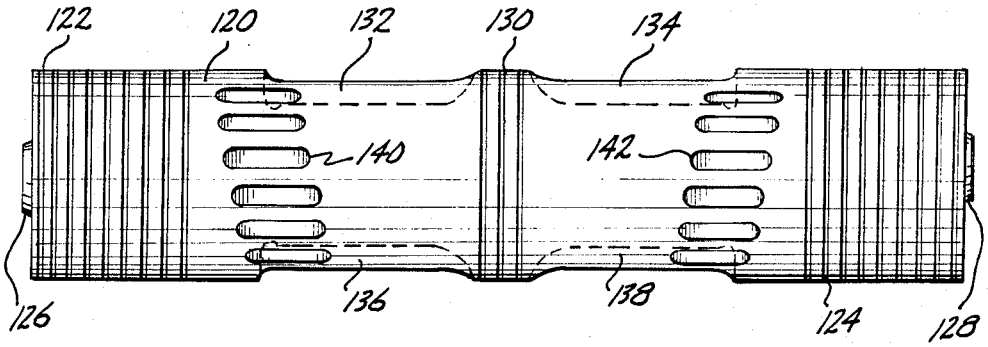
FIG. 3 is a side elevational view of one embodiment of a control valve spool made in accordance with the principles of the present invention for use with the intensifier of FIG. 1.
Figure 5:
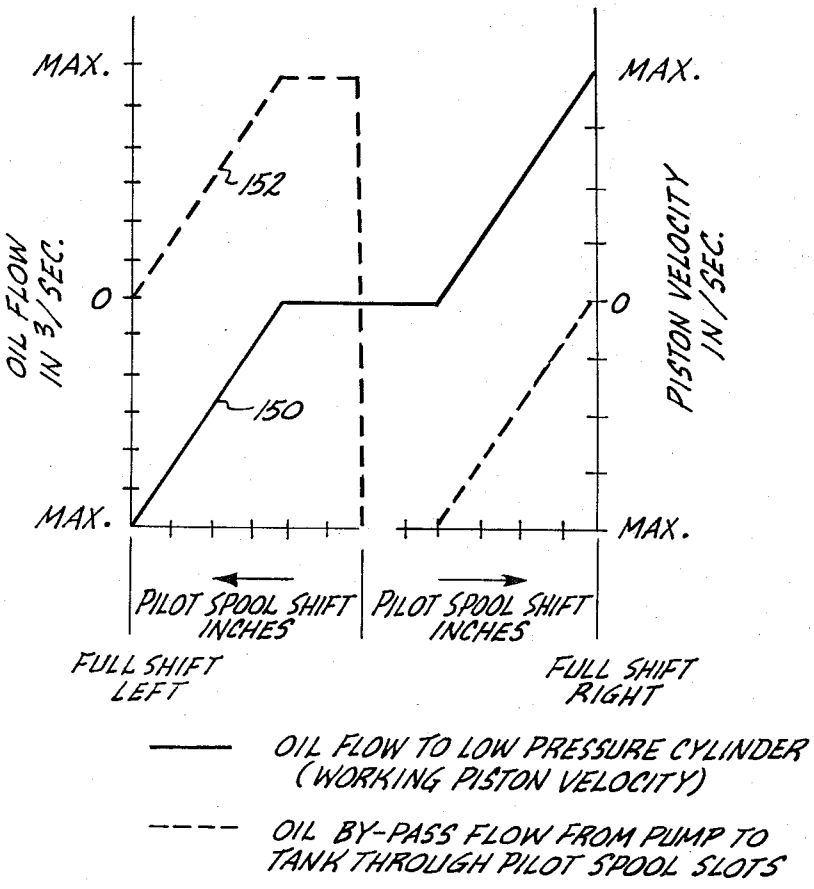
FIG. 5 is a graph showing the oil flow characteristics of the control valve containing the spool of FIG. 3 and the piston motion characteristics of the low-pressure piston.

As was mentioned earlier, the manifold 56 that channels the flow of oil from the control valve 54 to the ports 50 and 52 of the low-pressure cylinder is of conventional construction. The valve 54 comprises a valve body of substantially conventional construction also. However, the valve spool is of a configuration that forms part of this invention and is illustrated in FIGS. 3 and 4. FIG. 3 is a side elevational view of a valve spool 120 made in accordance with the principles of the present invention. The spool 120 is essentially cylindrical and has a plurality of circumferentially formed grooves 122 at a first end thereof and an identical set of circumferentially formed grooves 124 formed at the second end thereof. The grooves 122 and 124 function to provide centering of the spool within the valve body. The spool 120 also has a button 126 formed at the first end and an identical button 128 formed at the second end of the spool. The buttons function to cushion the shock of the spool as it reaches its full right or left travel within the valve body. Another set of centering grooves 130 is formed circumferentially about the central portion of the spool. Four diametrically opposed axially symmetric grooves 132, 134, 136, and 138, respectively, are formed in the surface of the cylindrical spool 120. Preferably, the grooves are formed by a ball mill to the particular shape pictured in FIGS. 3 and 4. A series of smaller indentations or slots 140 are formed in the surface of the spool between the grooves 132 and 136 and a second set of slots grooves 142 are formed on the opposite side of the spool between the grooves 134 and 138. FIG. 4 is a planar projection of the unrolled surface of the spool 120, except that the centering grooves 130 are not shown for the sake of simplicity. In FIG. 4 the lines on either side of the letter designations T, B, P, and A represent the boundaries of a port formed in the valve body utilized in conjunction with the spool 120. The areas between the lines that have no letter designations in them represent lands formed in the valve body. The letter P represents the pressure port where fluid at working pressure from the source of working fluid enters the valve body; the letters A and B represent the A and B ports that lead, respectively, to the ports 52 and 50 on the low-pressure cylinder 10 to feed working fluid to the interior of the low-pressure cylinder; and the ports designated with the letter T represent the tank ports or the ports that direct fluid back to the working fluid supply tank. FIG. 4 shows the valve spool in a center position within the valve body and corresponds to the line marked CP on the graph of FIG. 5. The valve spool and body are configured in such a manner that, in typical fashion at the full right-hand travel of the spool, a full flow of fluid from the pressure port is directed to the B port and the A port is connected to the tank port. In that situation, for example, the fluid flows to the port 50 and, as pictured in FIG. 1, forces the cylinder 12 to the right. The working fluid exiting from the port 52 at the right-hand side of the cylinder 10 would flow through the A port back to the tank. Likewise, when the spool 120 is shifted fully to the left, the pressure port is connected to the A port and the B port is connected to the tank so that the pump supplies pressurized working fluid to the port 52, causing the piston assembly 12 to move to the left, and fluid exits the interior of the cylinder 10 through the port 50 through the B port of the control valve back to the tank. A common problem in pressure intensifiers occurs when the direction of motion of the low-pressure piston is to be reversed. Because of the compression of water in the high-pressure cylinder, at the end of the pressure stroke, removal of all pressure from the pressurized side of the low-pressure piston, as a step function, and pressurization of the until-then unpressurized side of the low-pressure piston, in a corresponding step function, causes a sudden reversal of direction that can trigger a shock in the high-pressure cylinder due to the relaxation of the compressed water in the end of the high-pressure barrel. This sudden relaxation and resultant shock put high stress on the parts of the intensifier and increase the rate of wear. In order to cushion the shock, it is desirable to make a smooth transition in directional change by controlling the flow of working fluid into the low-pressure cylinder 10. The slots 140 and 142 provide intermediately restricted orifices calculated to provide intermediate flow between the A and B ports and the pressure port and tank ports to provide such controlled flow to the cylinder 10. It should be noted that the pump that supplies working fluid from the tank to the low-pressure cylinder, via the control valve, is preferably a constant-pressure, constant-rate pump and, ideally, the pump should not detect any change in the direction of motion of the low-pressure piston. The pump should continue to provide a constant-volume output of fluid at constant pressure, and any adjustment in flow rate should be taken care of by the control valve spool arrangement. In fact FIG. 5 illustrates the flow characteristics of the oil to the cylinder 10 through the control valve ports. It can be seen from FIG. 5 that when the control spool of the present invention is shifted fully to the left the oil flow to the low-pressure cylinder is at its maximum. At this time, the velocity of the low-pressure piston is also at a maximum, meaning that the piston is moving either to the right or to the left during a working stroke. At some point before the piston 12 reaches the end of its stroke, it trips the limit switch 58, which in turn shifts the pilot spool toward the right to eventually change the direction of motion of the low-pressure piston 12. As the spool shifts toward the right, a passage opens between the A port and its respective tank port through the system of slots 142 to bleed oil from the A port to the tank, thereby reducing the flow of oil to the low pressure cylinder through the A port. As indicated by the solid line 150 in FIG. 5, as the spool 120 continues to shift to the right the larger becomes the passage for the oil from the A port to the tank T and, consequently, there is a diminishing or reducing flow of oil through the A port to the low-pressure cylinder. The flow reduction is linearly programmed so as to decelerate the piston uniformly to zero velocity when the spool is within a predetermined distance from the center position. At the same time, because of the slots 140 and 142, a widening orifice is presented to the tank ports allowing the flow of oil to the tank through the slots to continually increase linearly and in conjunction with the decrease in flow to the low-pressure cylinder. The bypass oil flow from the pump to the tank through the control valve spool slots 140 and 142 is represented by the line 152 in FIG. 5. The summation of the low-pressure cylinder oil flow and the bypass flow demonstrates that the total flow of oil from the pump to the tank is constant and is the maximum output of the pump. At the center position of the spool, indicated by the line marked CP in FIG. 5, there is actually a bridge developed between the A and B ports such that while there is pressure in both the A and B ports, and therefore pressure in both sides of the low-pressure piston 12, there is no oil flow into or out of the low-pressure cylinder and all of the oil flow is through the slots 140 and 142 to the tank. As the spool continues its shift to the right, the zero flow to the cylinder is maintained to a predetermined point of shift, at which time the linear increase in flow to the cylinder again begins and the linear decrease in flow through the slots to the tank is also taking place, so that when the spool reaches its full right position, there is a maximum flow of oil to the low-pressure cylinder and a zero flow of oil through the slots back to the tank. Since the motion of low-pressure piston 12 is determined by the flow of oil into and out of the low-pressure cylinder 10, the piston velocity is also represented by line 150. The piston velocity tracks the oil flow to the low-pressure cylinder from the A and B ports and it can be seen that the piston velocity is maximum when the spool is at its either full right or full left position and is linearly changing during the spool shift, except for a zero piston velocity at the center position of the spool and a predetermined increment on either side of the center position, during which there is no flow to the low-pressure cylinder. Again, it must be remembered that, even though there is no flow to the low-pressure cylinder, at the center position, there is fluid pressure on both sides of the piston because of the bridging effect of the slots between the A and B ports. Therefore, the fluid pressure on the formerly unpressurized side of the low-pressure piston increases to system pressure and the pressurized side of the low-pressure piston decreases in pressure to a zero pressure or tank pressure in a controlled function cushioning the shock that would otherwise be caused by the direction reversal. During the whole process, the pump supplying working fluid to the low-pressure cylinder is unable to detect any change in spool direction or variation in pressures in the hydraulic cylinder 10 and simply operates at its maximum flow rate and working pressure, continually, through the entire operation and change in direction of the control valve spool and working piston 12. The size of the slots 140 and 142 and the grooves 132, 134, 136, and 138, are determined on the basis of flow rates and working pressures of a given system. In a system in which the present invention has been employed, in an intensifier that is designed to produce one gallon per minute flow at 60,000 psi, the working pressure of fluid in the low-pressure cylinder has been determined to be optimum at 2700 psi. The flow rate of fluid from the pump is 86.6 gallons per minute. In such a system, the zero oil flow to the working piston occurs at the center position of the control valve spool and over the range of positions 0.08 inches on either side of the center position with a total pilot spool movement of 0.48 inches right to left. In the system described, the maximum piston velocity of the working piston is 5.8 inches per second. The above values are given as examples only and are not intended to limit the scope of the invention. For other applications, the pressures and flow rates of the working fluid and the piston velocity of the low-pressure piston would be different and would be determined by the parameters of the particular system. However, it is contemplated by the invention that the linear flow rate control with center position plateau as illustrated by FIG. 5 would still be present in any spoolmade in accordance with the present invention. The slope of the lines 150 and 152 may be different, but would still represent a linear change in flow rate, and the sum of the flow rates through the bypass slots and the ports would still equal the maximum capacity of the constant-output pump.

In summary, a fluid pressure-intensifying apparatus is described that includes a reciprocating working piston drivingly connected to opposed high-pressure pistons. The high-pressure pistons are reciprocably movable within high-pressure cylinders to compress fluid within the high-pressure cylinder and expel it from the cylinder at high pressures. The movement of the working piston is controlled by a control valve that alternately directs a working fluid to the chambers of the working cylinder containing the working piston. The control valve includes a spool that moves within a valve body to open and close ports in the valve body that communicate with the source of working fluid and the working cylinder. The spool is configured to control the flow of working fluid to the working cylinder to provide a smooth change of direction of motion of the working piston at each end of its stroke. By controlling the change of direction of the working piston, the intensifier of the present invention experiences less shock within the high-pressure cylinders than prior art intensifiers. The spool of the control valve is configured to maintain a constant flow and pressure of working fluid from the pump in the hydraulic system but bypasses some of the flow from the pump back to the tank while the spool is moving between its two control positions. While a particular spool configuration has been described and illustrated, it will be understood by those of ordinary skill in the art that other configurations may be used to provide the flow characteristics of a spool of the present invention. Further, while a preferred embodiment of an intensifier made in accordance with the principles of the present invention has been described and illustrated, certain changes can be made to portions of the intensifier while remaining within the scope of the invention. Therefore, the invention should be defined solely by reference to the appended claims.

The embodiments of the invention in which an exclusive property or privilege is claimed are defined as follows:

1. A fluid pressure-intensifying apparatus to provide a flow of high-pressure fluid comprising:

a low-pressure cylinder;

a low-pressure piston mounted in said low-pressure cylinder and separating said low-pressure cylinder into first and second low-pressure chambers;

a high-pressure cylinder associated with said low-pressure cylinder;

high-pressure piston means mounted in said high-pressure cylinder and connected in driven relationship to said low-pressure piston;

a source of low-pressure fluid at a predetermined pressure;

a tank for receiving a return flow of low-pressure fluid from said low-pressure cylinder;

a control valve operatively connected to said low-pressure cylinder to direct the flow of low-pressure fluid from said source alternately to said first and second low-pressure chambers to cause reciprocating movement of said low-pressure piston within said low-pressure cylinder, said control valve including a valve body, said valve body having a pressure port in fluid communication with said supply of low-pressure fluid, at least one tank port in fluid communication with said tank, a first working port in fluid communication with said first low-pressure chamber and a second working port in fluid communication with said second working chamber; and a valve spool mounted within said valve body for movement between a first position in which it directs the flow of low-pressure fluid to said first low-pressure chamber and a second position in which it directs low-pressure fluid to said second low-pressure chamber, said valve spool constructed and arranged so as to maintain a substantially constant volumetric flow of low-pressure fluid from said low-pressure fluid source at a constant pressure when said valve spool is in said first and second position and in all intermediate positions between said first and second positions of said valve spool; wherein said spool has first and second lands at opposite ends thereof, a third land intermediate said opposite ends, and recessed portions intermediate (a) said first and third lands and (b) said second and third lands;

said spool further has first slots formed only in said recessed portions thereof, and a plurality of second slots formed therein;

each of said second slots is formed partially in one of said recessed portions and partially in one of said first and second lands; and major lengths of given ones of said second slots are formed in said one recessed portion, and major lengths of others of said second slots are formed in said one land.

2. The pressure-intensifying apparatus of claim 1, wherein said second slots comprise a series of slots formed in the surface of said spool, said first and second slots being operable, when said valve spool is intermediate said first and second positions, to bypass a predetermined amount of low-pressure fluid from said low-pressure fluid source to said tank to maintain the constant flow and pressure of said low-pressure fluid from said low-pressure fluid source.

3. The pressure-intensifying apparatus of claim 2, wherein said slots in said valve spool are constructed and arranged so that at the center position of said valve spool within said valve body there is no flow of low-pressure fluid to or from said low-pressure cylinder and the total flow of low-pressure fluid from said supply to said tank is by means of said slots formed in the surface of said valve spool.

4. The pressure-intensifying apparatus of claim 3 wherein said slots in the surface of said valve spool are constructed and arranged so that as said valve spool moves from its first position to the intermediate position at which zero flow to the low-pressure cylinder occurs, there is a linear decrease in flow from the supply to the low-pressure cylinder and a corresponding linear increase in flow from said supply to said tank through said slots such that at any point along said travel the sum of the flow to said low-pressure cylinder and the bypass flow is a constant.

5. The fluid pressure-intensifying apparatus of claim 1 further including a first limit switch means associated with said first chamber of said low-pressure cylinder and a second limit switch means associated with said second chamber of said low-pressure cylinder, said first and second limit switch means adapted to sense the movement of said low-pressure piston within said low-pressure cylinder and operably connected to said control valve to move said control valve spool between its first and second positions.

6. The fluid pressure-intensifying apparatus of claim 5 wherein said control valve is a solenoid-actuated valve.

7. The fluid pressure-intensifying apparatus of claim 4 wherein said valve spool includes a plurality of circumferential grooves formed in the exterior surface of said spool adjacent a first end thereof and a plurality of circumferential grooves formed in said spool surface adjacent a second end thereof, said grooves cooperating with said fluid within said control valve body to center said spool radially within said control valve body.

* * * * *